US008500498B2

(12) United States Patent
Abundis et al.

(10) Patent No.: US 8,500,498 B2
(45) Date of Patent: Aug. 6, 2013

(54) ELECTRICAL WIRE AND SHEET-METAL CONNECTOR

(75) Inventors: Paula Bulnes Abundis, Puebla (MX); Fabiola Gutierrez Gomez, Nuevo Leon (MX)

(73) Assignee: Schneider Electric USA, Inc., Palatine, IL (US)

( * ) Notice: Subject to any disclaimer, the term of this patent is extended or adjusted under 35 U.S.C. 154(b) by 0 days.

(21) Appl. No.: 13/308,679

(22) Filed: Dec. 1, 2011

(65) Prior Publication Data

US 2013/0143427 A1 Jun. 6, 2013

(51) Int. Cl.
*H01R 4/48* (2006.01)

(52) U.S. Cl.
USPC ..... 439/828

(58) Field of Classification Search
USPC ..... 439/828, 835, 796, 822, 864, 863, 439/419
See application file for complete search history.

(56) References Cited

U.S. PATENT DOCUMENTS

| | | | | |
|---|---|---|---|---|
| 2,615,072 | A | 10/1952 | Gilbert | 173/358 |
| 2,657,367 | A | 10/1953 | Brooks | 339/99 |
| 3,018,461 | A | 1/1962 | Smith | 339/95 |
| 3,125,392 | A | 3/1964 | Winter | 339/95 |
| 3,898,896 | A | 8/1975 | Suhay | 81/72 |
| 4,768,981 | A * | 9/1988 | Hohorst | 439/835 |
| 4,842,545 | A | 6/1989 | Tilse | 439/393 |
| 5,470,254 | A | 11/1995 | Kaney | 439/439 |
| 5,601,448 | A | 2/1997 | Poon | 439/419 |
| 5,860,830 | A | 1/1999 | Wu | 439/419 |
| 6,004,168 | A * | 12/1999 | Fuchs et al. | 439/835 |
| 6,689,955 | B2 * | 2/2004 | Doutaz | 174/652 |
| 2003/0228801 | A1 | 12/2003 | Holzer | 439/608 |
| 2012/0067613 | A1 * | 3/2012 | Yu et al. | 174/59 |

OTHER PUBLICATIONS

Wago Connector Series 222 http://www.wago.us.2631.htm , download date Feb. 13, 2012; (2 pages).
Wago Connector Series 224 http://www.wago.us/323.htm , download date Feb. 13, 2012; (1 page).

* cited by examiner

*Primary Examiner* — Gary F. Paumen
(74) *Attorney, Agent, or Firm* — Nixon Peabody LLP

(57) ABSTRACT

Electrical connector assemblies, light bases with one or more electrical connector assemblies, and methods for connecting one or more electrical wires to one or more sheet-metal connectors are disclosed. An electrical connector assembly for an electrical distribution system is disclosed, which includes an electrically insulated housing with a wire-connection port and a blade-connection port. The wire-connection port is designed to receive an electrical wire, while the blade-connection port is designed to receive an electrically conductive blade. An electrical conductor is disposed within the housing, extending between the blade-connection and wire-connection ports. A first threadless fastener secures the wire in the wire-connection port and electrically couples the wire to the electrical conductor. A second threadless fastener secures the blade in the blade-connection port and electrically couples the blade to the electrical conductor. The wire-connection port may be configured to open and release the electrical wire without the use of a tool.

20 Claims, 7 Drawing Sheets

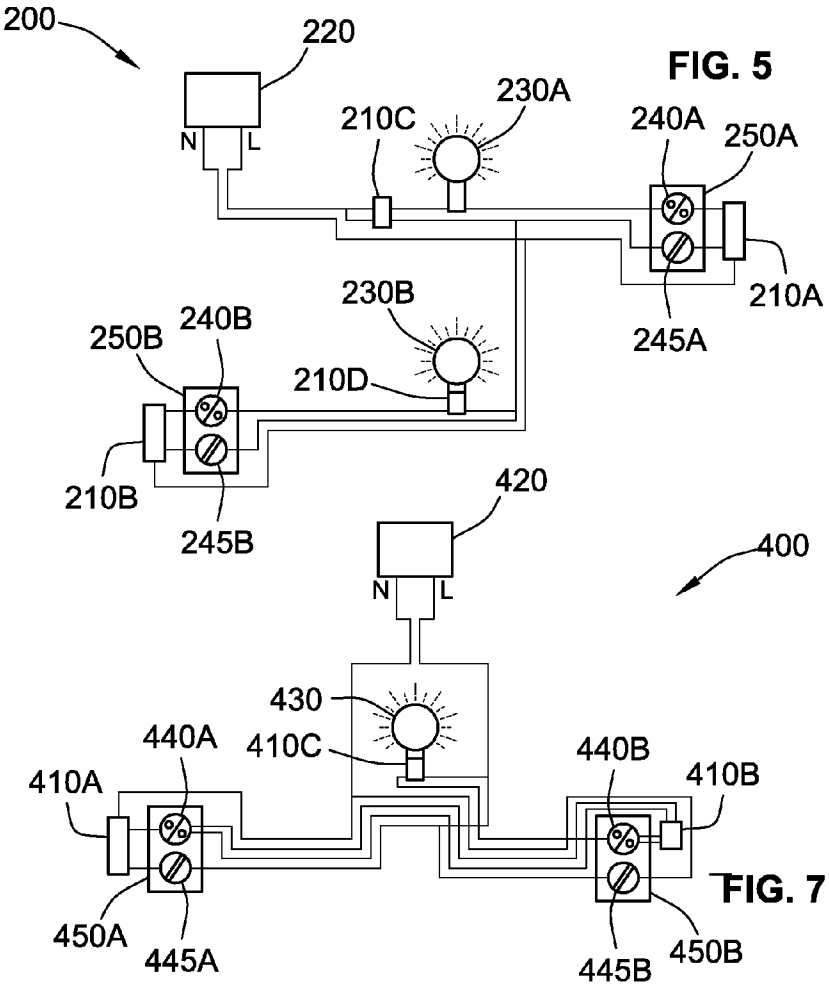
FIG. 5
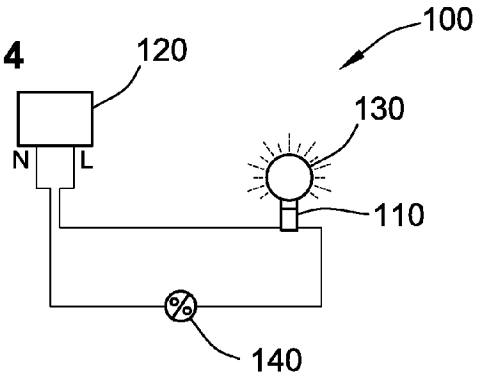
FIG. 4
FIG. 7
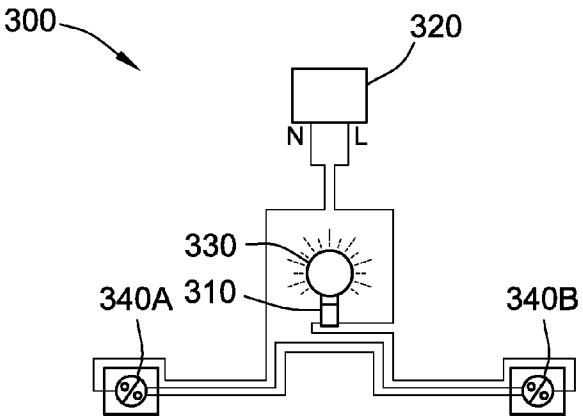
FIG. 6

ELECTRICAL WIRE AND SHEET-METAL CONNECTOR

TECHNICAL FIELD

The present disclosure relates generally to electrical distribution systems, and more particularly to connectors for electrical components in an electrical distribution system.

BACKGROUND

Incandescent lamps (more commonly known as "light bulbs") dominate residential lighting markets due to their relatively low cost and unparalleled accessibility. The glass-encased metal filament, which is electrically heated to generate light, is typically supplied with electrical current by wire feed-through terminals embedded within the bulb's threaded metal base. Most light bulbs are designed to thread into a light socket (also known as an "Edison base") which provides mechanical support for the bulb and connects the current supply to the bulb's electrical terminals. Other artificial lighting lamps, such as fluorescent, halogen, high-intensity discharge (HID), and even light-emitting diode (LED) lamps, are available with bases that are compatible with standard Edison light sockets.

The light socket, in turn, is often part of a light base which is attached to, or designed for attachment to, a support structure. Historically, light bases are powered through a cable-to-cable connection with an electrical utility system. The most common connectors have a single input-connection feature and a single output-connection feature, each of which is secured by a screw or other threaded fastening means. Some specialized connectors provide several entrance features that operate as input/output connections. Screw-type attaching means, however, require separate tools and additional labor time to complete each electrical connection, and are prone to improper installation which can lead to a defective connection.

The connector is typically designed as a "safety box" to prevent inadvertent handling of live electrical parts. For some light bases, the connection from the electrical grid is via a small sheet-metal component known as a "blade" and not by wire. This configuration allows the connector to energize components with different geometries in a reduced space. Due to cost and packaging constraints, however, some light bases provide less space between the socket and the connector box. Nevertheless, the connector must still provide all of the requisite cabling and connections inside of this limited packaging space.

SUMMARY

In accord with aspects of this disclosure, various multi-cable to sheet-metal connector assemblies are presented that eliminate prior art connectivity issues including, for example, those that appear in reduced spaces and those caused by fast, careless installations. Some of the potential benefits include, for example, eliminating the need for additional tooling to make the individual connections, which results in a reduction in installation time and costs. The simplified connection interface also helps to eliminate improper installation and, thus, defective connections. Some embodiments provide independent interfaces for each connection, which enables the interaction between individual current-carrying elements without the need of having all of the connections being used. Additional advantages can include a smaller connector with volume optimization that is ideal for constrained packaging spaces. Some advantages can also include the ability to energize a large number of cables and blades, improved safety, and faster, simpler connections.

According to aspects of the present disclosure, an electrical connector assembly is presented for an electrical distribution system with an electrical wire and an electrically conductive blade. The electrical connector assembly includes an electrically insulated housing with a wire-connection port and a blade-connection port. The wire-connection port is configured to receive therein the electrical wire, and the blade-connection port is configured to receive therein the electrically conductive blade. An electrical conductor is disposed within the housing, extending between the blade-connection port and the wire-connection port. The electrical connector assembly also includes first and second threadless fasteners. The first threadless fastener is configured to secure the wire in the wire-connection port and electrically couple the wire to the electrical conductor. The second threadless fastener is configured to secure the blade in the blade-connection port and electrically couple the blade to the electrical conductor.

Other aspects of the present disclosure are directed to an electrical connector assembly for an electrical distribution system with a plurality of electrical wires and an electrically conductive blade. This electrical connector assembly includes an electrically insulated housing with a plurality of wire-connection ports and a blade-connection port. Each of the wire-connection ports is configured to receive therein one of the electrical wires, whereas the blade-connection port is configured to receive therein the electrically conductive blade. An electrical conductor is disposed within the housing, extending between the blade-connection port and the wire-connection ports. The electrical connector assembly also includes a plurality of threadless wire-fasteners, each of which is configured to secure a wire in a corresponding one of the wire-connection ports and electrically couple that wire to the electrical conductor. A threadless blade-fastener is configured to secure the blade in the blade-connection port and electrically couple the blade to the electrical conductor. The electrical conductor is configured to electrically connect each wire received in the wire-connection ports with the blade received in the blade-connection port.

Other aspects of the present disclosure are directed to a light base for electrically connecting a light bulb to a power source. The light base includes an electrically insulated baseplate with a light socket. One or more electrically conductive blades are mounted on and electrically connected to the light socket. An electrically insulated housing, which is attached to baseplate, the light socket, or both, has a wire-connection port and a blade-connection port. The wire-connection port is configured to receive therein an electrical wire. One of the electrically conductive blades is received in the blade-connection port. An electrical conductor is disposed within the electrically insulated housing, extending between the blade-connection port and the wire-connection port. A first threadless fastener is configured to secure the wire received in the wire-connection port and electrically couple the wire to the electrical conductor. A second threadless fastener secures the blade in the blade-connection port and electrically couples the blade to the electrical conductor.

The above summary is not intended to represent each embodiment or every aspect of the present disclosure. Rather, the foregoing summary merely provides an exemplification of some of the novel features included herein. The above features and advantages, and other features and advantages of the present disclosure, will be readily apparent from the following detailed description of the embodiments and best modes for carrying out the present invention when taken in connection with the accompanying drawings and appended claims.

BRIEF DESCRIPTION OF THE DRAWINGS

FIG. 4 is a circuit diagram of a single light system (source-light-switch) in accordance with aspects of the present disclosure.

FIG. 5 is a circuit diagram of a dual-light dual-switch dual-contact system (source-light-switch/connector-light-switch/connector) in accordance with aspects of the present disclosure.

FIG. 6 is a circuit diagram of a dual-switch stair light system (source-light-switch/connector-switch/connector) in accordance with aspects of the present disclosure.

FIG. 7 is a circuit diagram of a dual-contact stair light system (source-switch-light-switch) in accordance with aspects of the present disclosure.

Figure 1A:
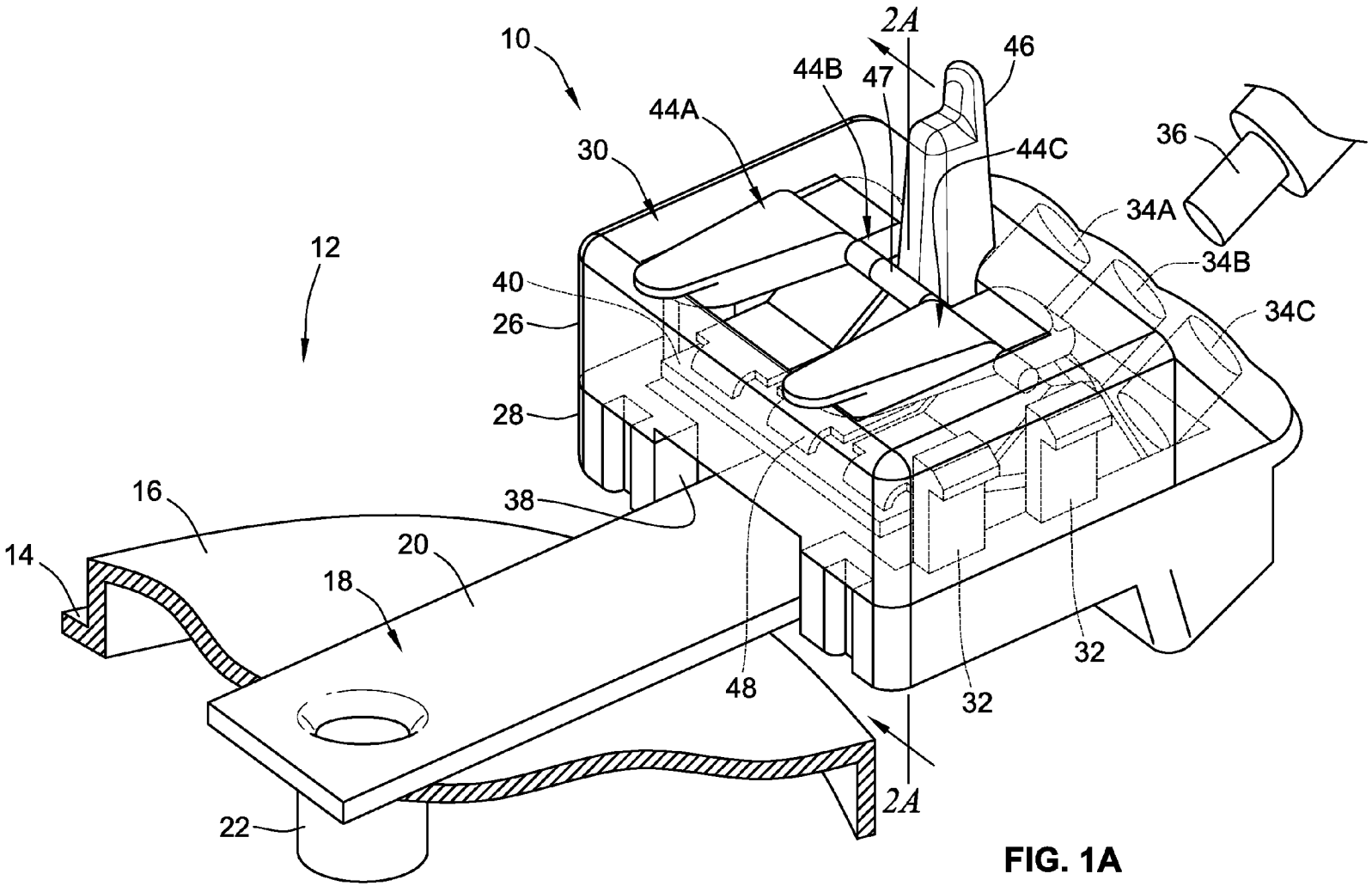
FIG. 1A is a perspective-view illustration of an exemplary electrical connector assembly in accordance with aspects of the present disclosure, FIG. 1A showing one of the wire-connection ports of the electrical connector assembly in an open state.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION

Figure 1B:
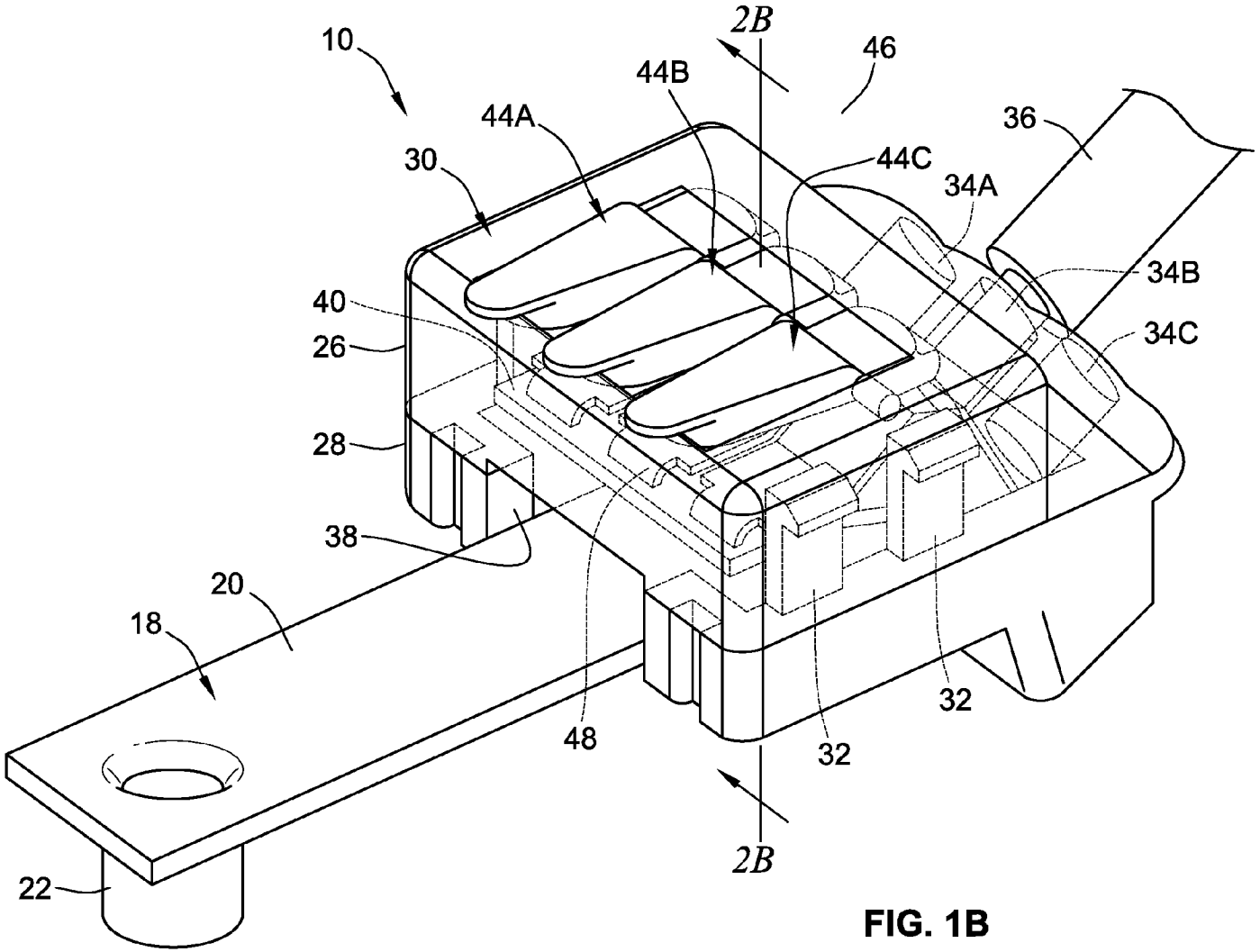
FIG. 1B shows the exemplary electrical connector assembly of FIG. 1 with the wire-connection port transitioned to a closed state to thereby secure an electrical wire to the electrical connector assembly and operatively connect the wire to an electrically conductive blade.

Referring now to the drawings, wherein like reference numerals refer to like components throughout the several views, FIGS. 1A and 1B illustrate an exemplary electrical connector assembly, designated generally as 10, in accordance with aspects of the present disclosure. In the illustrated example, the electrical connector assembly is part of a light base 12, which is intended for electrically connecting a light bulb to and/or disconnecting the light bulb from a power utility system. Nevertheless, it should be understood that the electrical connector assembly 10 can be employed in other electrical components, as well as other electrical distribution systems, without departing from the intended scope and spirit of the present disclosure. The light base 12 is represented herein FIG. 1A by a portion of an electrically insulated baseplate 14 and a portion of a light socket 16, which is shown integrally formed with and protruding generally perpendicularly from the baseplate 14. The light socket 16 can be any type of light socket, including an Edison-type socket, a fluorescent light bulb socket, a halogen light bulb socket, or an HID socket, as some non-limiting examples. The light base 12 may be attached to, designed for attachment to, or part of a support structure, such as fixed light fixture (e.g., surface-mounted and recessed lighting assemblies). Alternatively, the light socket 16 can be part of a free-standing light fixture, such as a table lamp or a floor lamp. In addition, although only one electrical connector assembly 10 is shown on the light base 12, two of or more connectors 10 can be operatively attached to the light base, one of which can be used, for example to interconnect ground cables.

One or more electrically conductive blades 18 are mounted on and electrically connected to the light socket 16 for transmitting electricity to and/or from a light bulb operatively engaged in the light socket 16. As shown, the blade 18 includes an elongated rectangular platform 20 with an integrally formed cylindrical junction 22 projecting from one end thereof. On the other end of the platform 20, opposite the cylindrical junction 22, is an integrally formed hook-shaped junction 24 (see FIGS. 2A and 2B). The size, shape, and general configuration of each blade 18 can be varied from the blade shown in the drawings, for example, to accommodate the intended application of the light base 12. For example, two or more blades 18 can be mounted to the light socket 16, one for connecting the live wire, one for connecting the switch, and one for connecting to the return.

The electrical connector assembly 10 of FIGS. 1A and 1B includes an electrically insulated housing 30, which can be affixed to the light socket 16 (as shown), mounted on the baseplate 14, or otherwise operatively attached to the light base 12. As shown, the housing 30 is a bipartite construction fabricated from two electrically insulating polymeric halves: an upper housing shell 26 and a lower housing shell 28, which are attached together, for example, via four snap-fasteners (two of which are shown hidden in FIGS. 1A and 1B at 32). Alternative embodiments may employ a unitary, single-piece housing, or a multi-component housing with more than two constituent parts.

The housing 30 is fabricated with at least one, and in some embodiments multiple wire-connection ports, for providing access points (e.g., openings) through which one or more electrical wires (one of which is shown at 36) can be passed into and secured to the housing 30. By way of example, three representative wire-connection ports are shown hidden in FIGS. 1A and 1B at 34A-34C. These three wire-connection ports 34A-34C are generally parallel to one another, laterally spaced along a first (forward-facing) surface of the upper housing shell 26 of the housing 30. Each wire-connection port 34A-34C is configured (e.g., shaped and sized) to receive therein a respective electrical wire 36 (e.g., a 10-14 AWG type wire). The number, location and geometry of the wire-connection ports 34A-34C can be varied from what is shown in the drawings. For example, the housing 30 can be provided with greater or fewer than three wire-connection ports, one or more of which can be positioned at other locations on the housing 30 besides the forward-facing surface of the upper housing shell 26 shown in FIGS. 1A and 1B.

The housing 30 is also fabricated with at least one blade-connection port 38 for providing an access point (e.g., an opening) through which one or more blades 18 can be passed into and secured to the housing 30. The blade-connection port 38 is shown positioned in opposing, spaced relation to the three wire-connection ports 34A-34C. By way of clarification, and not limitation, the illustrated blade-connection port 38 passes through a first (rearward-facing) surface of the lower housing shell 28, which is on the opposite side of the housing 30 than the wire-connection 34A-34C ports such that the opening of the blade-connection port 38 generally faces inwardly toward the opening of the three wire-connection 34A-34C ports. The blade-connection port 38 is configured (e.g., shaped and sized) to receive therein the electrically conductive blade 18. Similar to the wire-connection ports 34A-34C, the number, location and geometry of the blade-connection port 38 can be varied from what is shown in the drawings.

An electrical conductor 40 is disposed inside a cavity 42 within the housing 30, i.e., sandwiched between the upper and lower housing shells 26, 28. In the illustrated embodiment, for example, the electrical conductor 40 is a generally square shaped (in plan view) metallic plate extending between the wire-connection ports 34A-34C and the blade-connection port 38. The electrical conductor 40 has a first (forward) edge 41 opposing and spaced from a second (rearward) edge 43. The forward edge 41 of the electrical conductor 40 is configured (e.g., shaped and positioned) to contact and thereby electrically connect with the exposed ends of the electrical wires 36 received in each of the wire-connection ports 34A-34C. The rearward edge 43, on the other hand, is configured (e.g., shaped and positioned) to contact and thereby electrically connect with the hook-shaped junction 24 of the blade 18. In so doing, the electrical conductor 40 operates to electrically connect each wire received in the wire-connection ports 34A-34C with the blade 18 in the blade-connection port 38. The electrical conductor 40 is shown encased within the housing 30 so as to prevent inadvertent contact by a user with the electrical conductor 40 while "hot."

With continuing reference to FIGS. 1A and 1B, the electrical connector assembly 10 also includes one or more threadless wire-fasteners (also referred to herein as "first threadless fastener"), each of which is configured to secure a respective wire 36 in a corresponding one of the wire-connection ports 34A-34C, and contemporaneously electrically couple the wire 36 to the electrical conductor 40. In the illustrated embodiment, there are three threadless wire-fasteners 44A-44C, one designated for each of the wire-connection ports 34A-34C. The three threadless wire-fasteners 44A-44C of the illustrated embodiment are generally structurally identical; as such, for brevity and conciseness, the structure, operation and functionality of all three threadless wire-fasteners 44A-44C will be described with respect to the second threadless wire-fastener 44B. In alternative arrangements, one or more of the threadless wire-fasteners 44A-44C may take on a distinctive design.

Figure 2A:
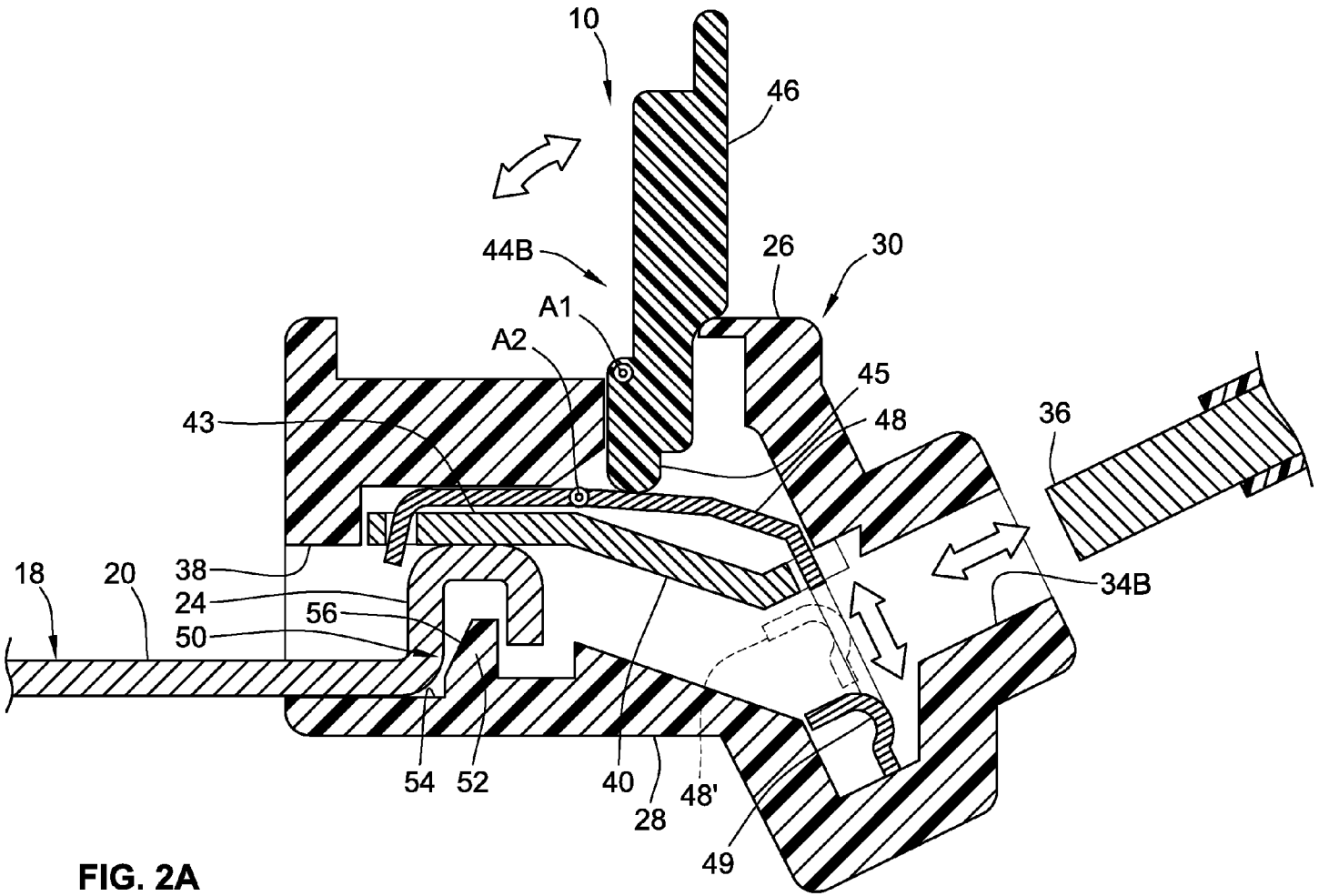
FIG. 2A is side-view illustration of the exemplary electrical connector assembly of FIG. 1A taken in partial cross-section along line 2A-2A.
Figure 2B:
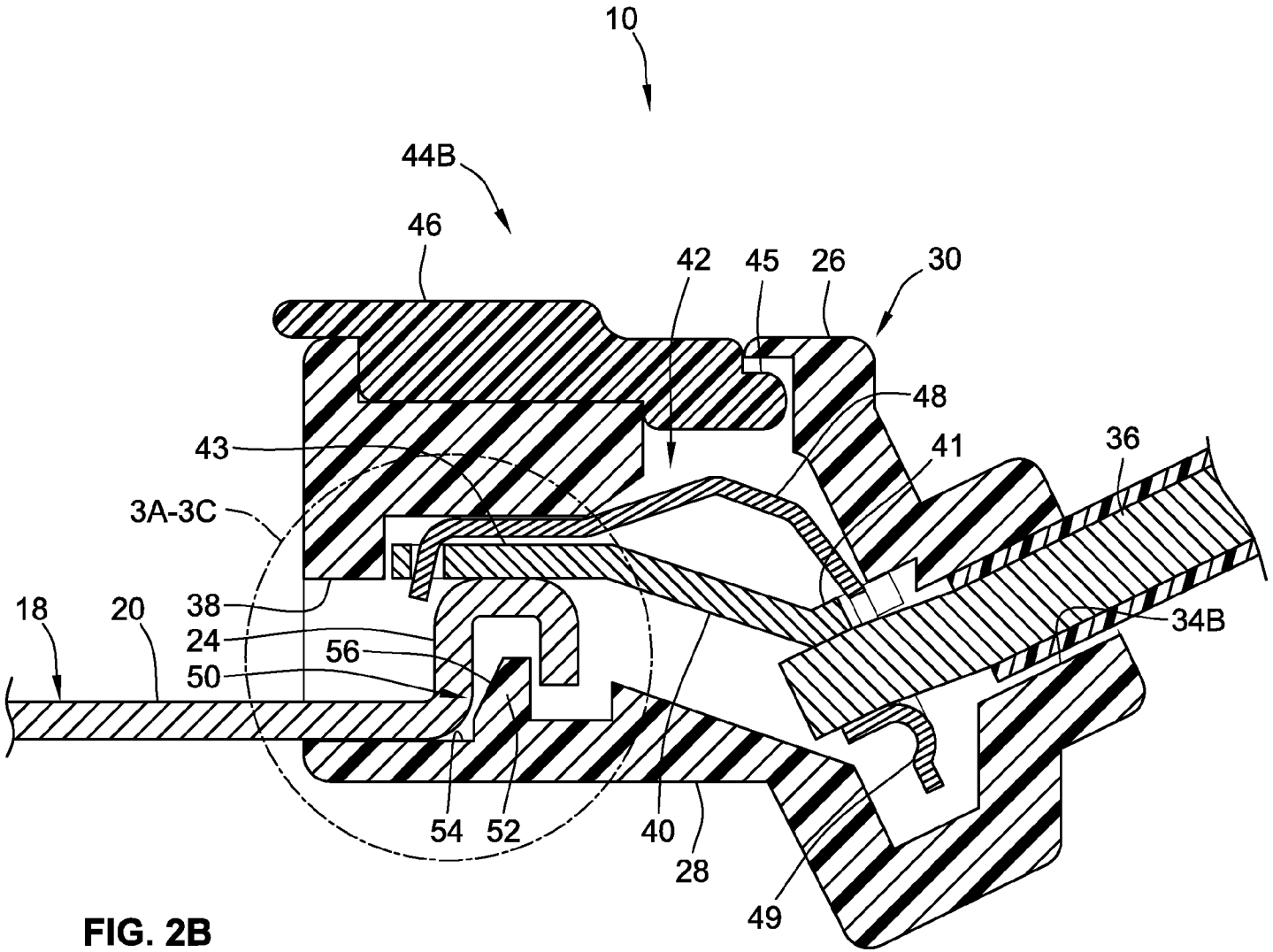
FIG. 2B is side-view illustration of the exemplary electrical connector assembly of FIG. 1A taken in partial cross-section along line 2B-2B of FIG. 1B.

The threadless wire-fastener 44B includes a lever 46 that is rotatably attached to the housing 30, e.g., via an integrally formed lateral hinge pin 47 with distal ends that are received in complementary slots in the upper housing shell 26, as seen in FIG. 1A. The lever 46 can be selectively rotated or otherwise transitioned (e.g., in a clockwise direction in FIGS. 1A and 1B) by a user from a open (locked) position, as portrayed in FIG. 1B, to a closed (unlocked) position (FIGS. 1A), and back. When the lever 46 is in the open/unlocked position, as seen in FIGS. 1A and 2A, the wire 36 can be readily transitioned in and out of the housing 30 via the wire-connection port 34B. In contrast, when the lever 46 is in the closed/locked position, as seen in FIGS. 1B and 2B, the wire 36 is either secured to the housing 30 in the wire-connection port 34B, or prevented from entering the housing 30 via the wire-connection port 34B, as will be developed in further detail hereinbelow. Similar to the wire-connection ports 34A-34C, the number, location and geometry of the levers can be varied from what is shown in the drawings.

In addition to the lever 46, the threadless wire-fastener 44B also includes a leaf spring 48 that is disposed within the same cavity 42 of the housing 30 as the electrical conductor 40, sandwiched between the upper and lower housing shells 26, 28. The leaf spring 48 is an elongated, generally rectangular strip of metal that is stamped or otherwise formed into a jagged, generally arcuate shape. As seen in FIGS. 2A and 2B, opposing ends of the leaf spring 48 are intermeshed with the electrical conductor 40 such that the leaf spring 48 is operatively positioned, guided, and retained within the cavity 42 by the conductor 40. Like the electrical conductor 40, the leaf spring 48 is shown encased within the housing 30 so as to prevent inadvertent contact by a user with the leaf spring 48 while "hot."

The leaf spring 48 can be selectively transitioned between a first (clamping) position, which is portrayed in FIG. 2B, and a second (releasing) position, which is portrayed in FIG. 2A. When in the first/clamping position, the spring-like elastic nature of the leaf spring 48 operates to clamp, press or otherwise position the exposed end of the wire 36 against the forward edge 41 of the electrical conductor 40 and thereby secures the wire 36 within the wire-connection port 34B of the housing 30. In the illustrated embodiment, the functional end 49 of the leaf spring 48 is biased by the elastic nature of the leaf spring 48, e.g., in an upward direction in FIGS. 2A and 2B, towards the first position. In so doing, the leaf spring 48 also operates to bias the lever 46, e.g., in a counter-clockwise direction in FIGS. 2A and 2B, toward the locked position (FIG. 2B).

The lever 46 can be selectively transitioned by a user from the locked position (FIG. 1B) to the unlocked position (FIG. 1A), during which a lower segment 45 the lever 46 presses against, urges or otherwise moves the leaf spring 48, e.g., in an downward direction in FIGS. 2A and 2B, from the first position (FIG. 2B) to the second position (FIG. 2A). As seen in FIG. 2A, the lever 46 rotates about a first axis A1 when transitioning from the locked position to the unlocked position, whereas the leaf spring 48 bends about a second axis A2, which is generally parallel to but distinct and spaced from the first axis A1, when transitioning between the first and second positions. When the leaf spring 48 moves to the second, releasing position, the functional end 49 of the leaf spring 48 electrically decouples the exposed end of the wire 36 from the electrical conductor 40 and generally physically disconnects the wire 36 from the housing 30 such that the wire 36 can transition in and out of the wire-connection port 34B. In the absence of the wire 36, the leaf spring 48 can, in some embodiments, be selectively transitioned to a third position (shown hidden in FIG. 2A at 48'), whereby the functional end 49 of the leaf spring 42 obstructs the wire-connection port 34B thereby preventing insertion of the wire 36 into the housing 30.

The electrical connector assembly 10 also includes at least one threadless blade-fastener (also referred to herein as "second threadless fastener"), which is configured to secure the blade 18 in the blade-connection port 38, and contemporaneously electrically couple the blade 18 to the electrical conductor 40. In the illustrated embodiment, there is one threadless blade-fastener, designated generally as 50 in the drawings; however, the electrical connector assembly 10 could be fabricated with a plurality of threadless blade-fasteners. The threadless blade-fastener 50 includes a locking projection 52 that protrudes generally perpendicularly from an inner, rearward surface 54 of the lower housing shell 28 of the housing 30, proximate the opening of the blade-connection port 38. Similar to the blade-connection port 38, the number, location and geometry of the locking projections can be varied from what is shown in the drawings. In alternative arrangements, the blade-connection port 38 and threadless blade-fastener 50 can be eliminated altogether, and replaced with another wire-connection port and threadless wire-connector.

Figure 3A:
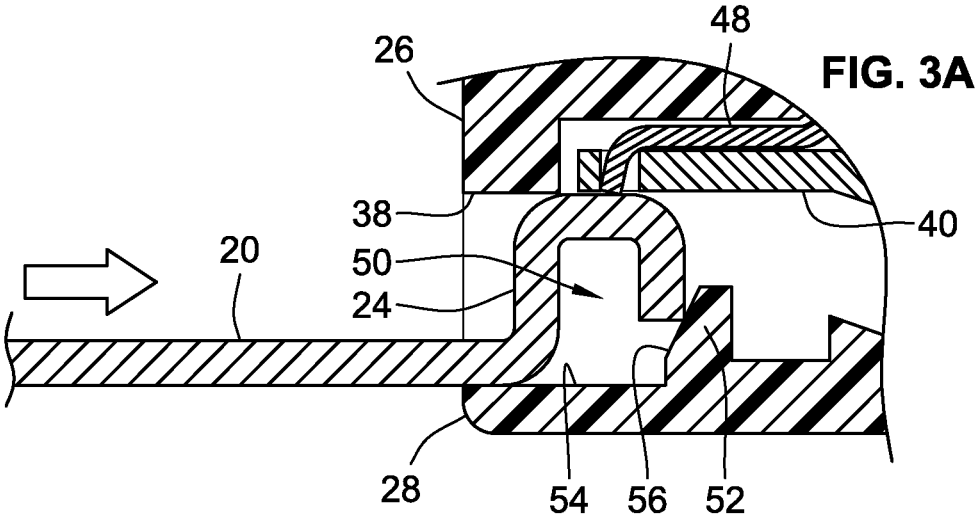
FIGS. 3A-3C are each enlarged side-view cross-sectional illustrations of the portion of the exemplary electrical connector assembly designated as 3A-3C in FIG. 2B, showing receipt and attachment of the electrically conductive blade in a blade-connection port of the electrical connector assembly.
Figure 3B:
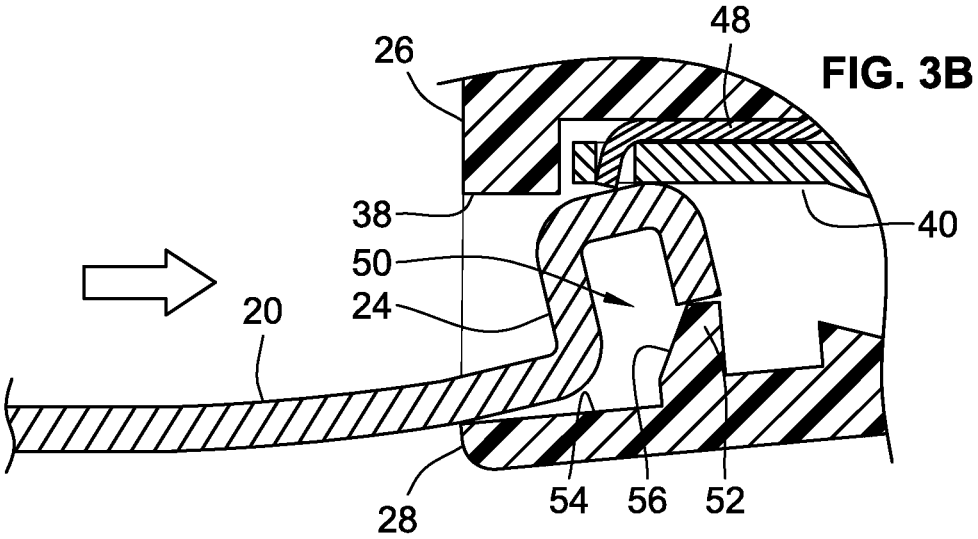
Figure 3C:
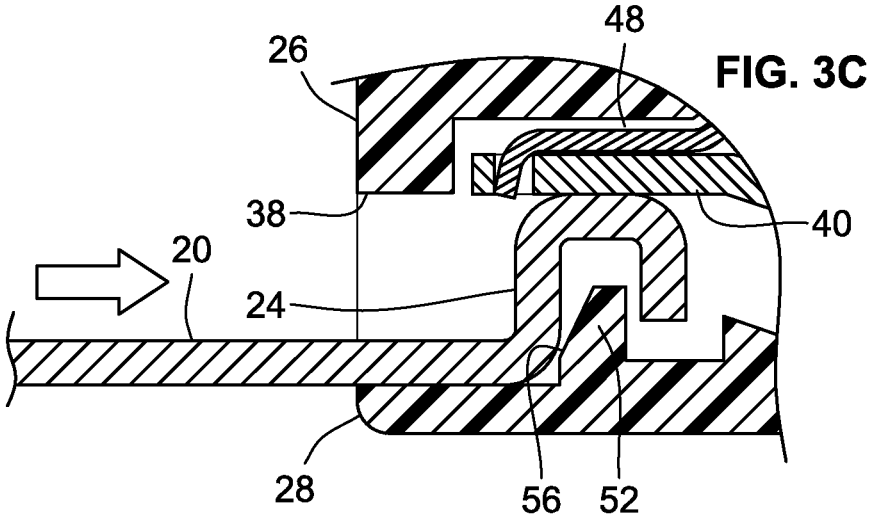

The locking projection 52 is configured (e.g., shaped, sized and positioned) to be received by a complementary portion of the blade 18, for example, in the hook-shaped junction 24. FIGS. 3A-3C are each enlarged side-view illustrations of a portion of the electrical connector assembly 10 which is designated 3A-3C in FIG. 2B. FIG. 3A shows the hook-shaped junction 24 of the blade 18 passing into the housing 30 via the blade-connection port 38. As the blade 18 is pressed or otherwise transitioned further into the housing, the nose of the hook-shaped junction 24 eventually abuts against the locking projection 52 and, as movement continues, begins to slide along a (rearward-facing) ramped surface 56 of the locking projection 52. As seen in FIG. 3B, the interplay between the hook-shaped junction 24 and the ramped surface 56 operates to deflect a portion of the housing 30 (e.g., a rearward portion of lower housing shell 28), a portion of the blade 18 (e.g., the hook-shaped junction 24), or both, when the blade 18 passes over the locking projection 52. Once the hook-shaped junction 24 passes over the projection 52, the projection 52 nests at least partially inside a recess formed by the hook-shaped junction 24, as seen in FIG. 3C. In so doing, the blade 18 is secured to the housing 30, inside the blade-connection port 38. In addition, the locking projection 52 and inner surface 54 of the threadless blade-fastener 50 cooperatively position the blade 18 (e.g., the hook-shaped junction 24) against the rearward edge 43 of the electrical conductor 40 when the blade 18 is secured to the housing 30.

In the illustrated embodiments, the threadless blade-fastener 50 and the threadless wire-fasteners 44A-44C can be characterized by a lack of structure configured to mate with an external tool for operating the individual threadless fasteners. By way of non-limiting example, the blade 18 can be operatively attached by a user to the electrical connector assembly 10 (e.g., secured to the housing 30 and electrically coupled to the electrical conductor 40), via the threadless blade-fastener 50, without the need for a screw driver, crimping pliers, or other separate tool or implement. Likewise, the wire(s) 36 can be operatively attached by a user to the electrical connector assembly 10 (e.g., secured to the housing 30 and electrically coupled to the electrical conductor 40), via the threadless wire-fasteners 44A-44C, without the need for a screw driver, crimping pliers, or other separate tool or implement. As a result, installation is simplified and controlled, which minimizes installation time and labor. Another potential benefit is a reduction or elimination of improper installations and, thus, defective electrical connections. As yet another potential benefit, installation of the blade 18 can be performed on an assembly line, eliminating a step for the installer, which in turn further reduces the possibility of an improper installation.

FIGS. 4-11 are circuit diagrams showing some representative implementations of one or more electrical connector assemblies in accordance with aspects of the disclosed concepts. FIG. 4, for example, is a circuit diagram of a single-light system 100, with a power source 120, a light 130, and a switch 140. An electrical connector assembly 110, which may be similar in construction to the electrical connector assembly 10 of FIGS. 1A and 1B, is installed in or otherwise attached to the base of the light 130 in a manner which may be similar to what is shown in FIGS. 1B and 2B.

FIG. 5 is a circuit diagram of a dual-light dual-switch dual-contact system 200, with a power source 220, two lights 230A and 230B, and two switch/connector assemblies 250A and 250B, each having a respective switch 240A and 240B, and a respective connector 245A and 245B. The dual-light dual-switch dual-contact system 200 of FIG. 5 also includes four electrical connector assemblies: a first electrical connector assembly 210A is attached (i.e., electrically coupled) to the first switch 240A and the first connector 245A of the first switch/connector assembly 250A; a second electrical connector assembly 210B is attached to the second switch 240B and the second connector 245B of the second switch/connector assembly 250B; a third electrical connector assembly 210C electrically connects the power source 220 to the first light 230A and the first switch/connector assembly 250A; and, a fourth electrical connector assembly 210D is attached to or disposed in the base of the second light 230B. Each of the electrical connector assemblies 210A-D may be similarly configured, and thus can include any or all of the optional features, of the electrical connector assembly 10 of FIGS. 1A and 1B.

Continuing with the representative circuit diagrams, FIG. 6 is a circuit diagram of a dual-switch stair light system 300, with a power source 320, a light 330, and two switches 340A and 340B. An electrical connector assembly 310, which may be similar in construction to the electrical connector assembly 10 of FIGS. 1A and 1B, is installed in or otherwise attached to the base of the light 330 in a manner which may be similar to what is shown in FIGS. 1B and 2B.

FIG. 7 is a circuit diagram of a dual-contact stair light system 400, with a power source 420, a light 430, and two switch/connector assemblies 450A and 450B, each having a respective switch 440A and 440B, with a respective connector 445A and 445B. The dual-contact stair light system 400 is also illustrated with three electrical connector assemblies: a first electrical connector assembly 410A is attached (i.e., electrically coupled) to the first switch 440A and the first connector 445A of the first switch/connector assembly 250A; a second electrical connector assembly 410B is attached to the second switch 440B of the second switch/connector assembly 450B; and a third electrical connector assembly 410C, which can be installed in or otherwise attached to the base of the light 430 in a manner that may be similar to what is shown in FIGS. 1B and 2B. Each of the electrical connector assemblies 410A-C may be similarly configured, and thus can include any or all of the optional features, of the electrical connector assembly 10 of FIGS. 1A and 1B.

Figure 8:
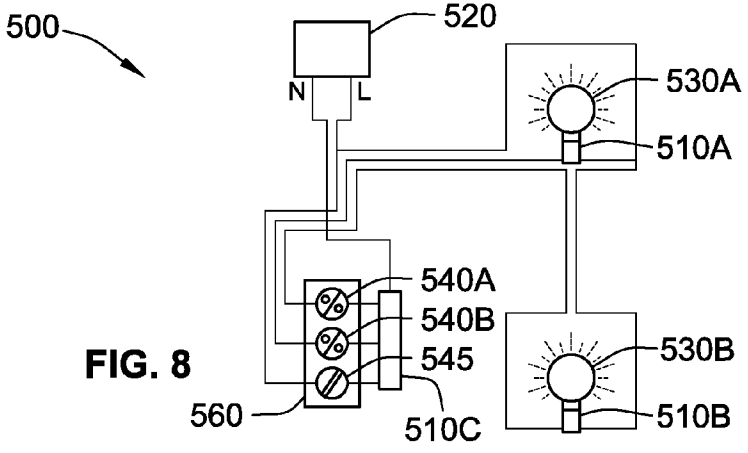
FIG. 8 is a circuit diagram of a dual-light dual-switch single-contact system (source-light-light-switch/switch/connector) in accordance with aspects of the present disclosure.

Turning next to FIG. 8, there is shown a circuit diagram of a dual-light dual-switch single-contact system 500, with a power source 520, two lights 530A and 530B each having a respective electrical connector assembly 510A and 510B, and a switch/switch/connector assembly 560 with two switches 540A and 540B and a connector 545. The first and second electrical connector assemblies 510A, 510B can each be installed in or otherwise attached to the base of its respective light 530A, 530B in a manner that may be similar to what is shown in FIGS. 1B and 2B. A third electrical connector assembly 510C is attached (i.e., electrically coupled) to the first and second switches 540A, 540B and the connector 545A of the switch/switch/connector assembly 560. Each of the electrical connector assemblies 510A-C may be similarly configured, and thus can include any or all of the optional features, of the electrical connector assembly 10 of FIGS. 1A and 1B.

Figure 9:
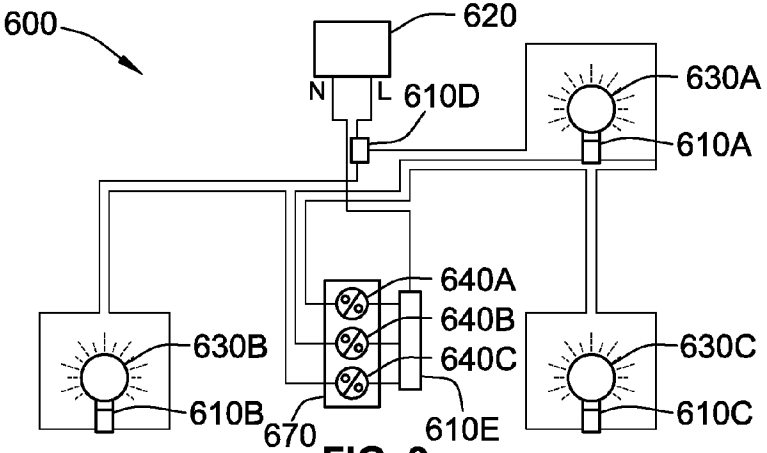
FIG. 9 is a circuit diagram of a triple-light triple-switch system (source-light-switch/switch/switch-light-light) in accordance with aspects of the present disclosure.

FIG. 9 is a circuit diagram of a triple-light triple-switch system 600, with a power source 620, three lights 630A, 630B and 630C, and a switch/switch/switch assembly 670 with three switches 640A, 640B and 640C. Similar to the diagrams illustrated in FIGS. 4 and 6, an electrical connector assembly 610A, 610B and 610C can be installed in or otherwise attached to the base of each light 630A, 630B, 630C, respectively, in a manner which may be similar to what is shown in FIGS. 1B and 2B. A fourth electrical connector assembly 610D electrically couples the power source 620 to the three lights 630A, 630B, 630C. A fifth electrical connector assembly 610E is electrically coupled to the three switches 640A, 640B, 640C of the switch/switch/switch assembly 670 as seen in FIG. 9. Each of the electrical connector assemblies 610A-E may be similarly configured, and thus can include any or all of the optional features, of the electrical connector assembly 10 of FIGS. 1A and 1B.

Figure 10:
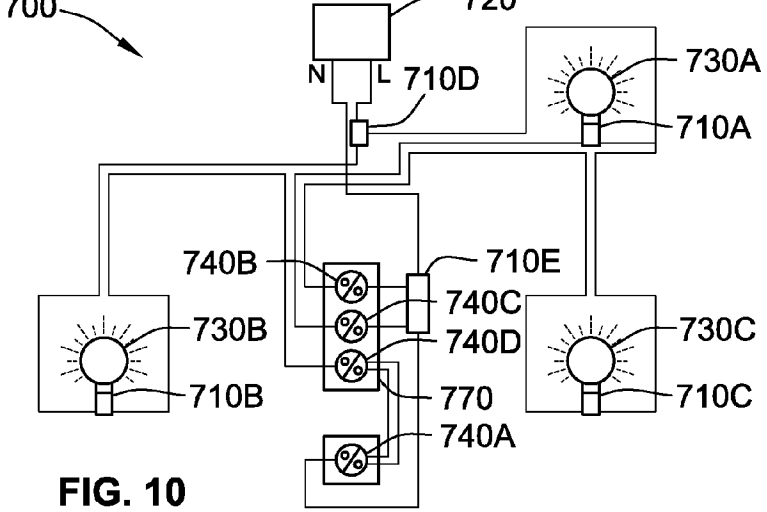
FIG. 10 is a circuit diagram of a dual-light stair light system (source-light-switch/switch/stair switch-light-light) in accordance with aspects of the present disclosure.

With reference now to FIG. 10, a circuit diagram is provided of a dual-light stair light system 700, with three lights 730A, 730B and 730C, a stair switch 740A, and a switch/switch/switch assembly 770 with three switches 740B, 740C and 740D. A respective electrical connector assembly 710A, 710B and 710C, can be installed in or otherwise attached to the base of each light 730A, 730B, 730C. A fourth electrical connector assembly 710D electrically couples the power source 720 to the three lights 730A, 730B, 730C. A fifth electrical connector assembly 710E is electrically coupled to the first and second switches 7640A, 740B of the switch/switch/switch assembly 770. Each of the electrical connector assemblies 710A-E may be similarly configured, and thus can include any or all of the optional features, of the electrical connector assembly 10 of FIGS. 1A and 1B.

Figure 11:
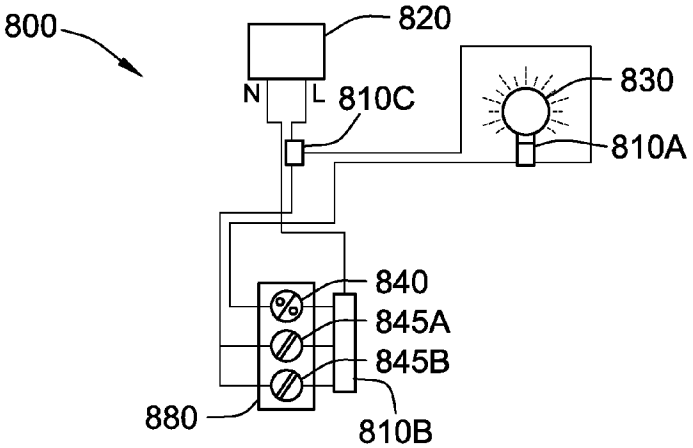
FIG. 11 is a circuit diagram of a single-light dual-contact light system (source-light-switch/connector/connector) in accordance with aspects of the present disclosure.

Lastly, FIG. 11 is a circuit diagram of a single-light dual-contact light system 800, with a power source 820, a light 830, and a switch/connector/connector assembly 880 with a switch 840 and two connectors 845A and 845B. A first electrical connector assembly 810A, which may be similar in construction to the electrical connector assembly 10 of FIGS. 1A and 1B, is installed in or otherwise attached to the base of the light 830 in a manner which may be similar to what is shown in FIGS. 1B and 2B. A second electrical connector assembly 810B is electrically coupled to the switch 840 and connectors 845A, 845B of the switch/switch/connector assembly 880. A third electrical connector assembly 810C electrically couples the power source 820 to the light 830. Each of the electrical connector assemblies 810A-C may be similarly configured, and thus can include any or all of the optional features, of the electrical connector assembly 10 of FIGS. 1A and 1B.

While exemplary embodiments and applications of the present disclosure have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims. To that extent, elements and limitations that are disclosed, for example, in the Abstract, Summary, and Detailed Description sections, but not explicitly set forth in the claims, should not be incorporated into the claims, singly or collectively, by implication, inference or otherwise.

What is claimed is:

1. An electrical connector assembly for an electrical distribution system with an electrical wire and an electrically conductive blade, the electrical connector assembly comprising:

an electrically insulated housing defining a wire-connection port and a blade-connection port, the wire-connection port being configured to receive therein the electrical wire, and the blade-connection port being configured to receive therein the electrically conductive blade;

an electrical conductor disposed within the housing and extending between the blade-connection port and the wire-connection port;

a first threadless fastener configured to secure the wire in the wire-connection port and electrically couple the wire to the electrical conductor; and a second threadless fastener configured to secure the blade in the blade-connection port and electrically couple the blade to the electrical conductor.

2. The electrical connector assembly of claim 1, wherein the first threadless fastener comprises a lever attached to the housing and configured to selectively transition between a locked position, whereat the wire is secured in the wire-connection port, and an unlocked position, whereat the wire can transition in and out of the wire-connection port.

3. The electrical connector assembly of claim 1, wherein the first threadless fastener comprises a leaf spring configured to selectively transition between a first position, whereat the leaf spring clamps the wire against the electrical conductor, and a second position, whereat the leaf spring electrically decouples the wire from the electrical conductor.

4. The electrical connector assembly of claim 3, wherein the first threadless fastener further comprises a lever attached to the housing and configured to selectively transition from a locked position to an unlocked position, whereat the lever moves the leaf spring from the first position to the second position such that the wire can transition in and out of the wire-connection port.

5. The electrical connector assembly of claim 4, wherein the leaf spring biases the lever toward the locked position.

6. The electrical connector assembly of claim 4, wherein the lever rotates about a first axis when transitioning from the locked position to the unlocked position, and wherein the leaf spring bends about a second axis, distinct from the first axis, when transitioning between the first and second positions.

7. The electrical connector assembly of claim 4, wherein the leaf spring is further configured to selectively transition to a third position, whereby the leaf spring obstructs the wire-connection port thereby preventing insertion of the wire into the housing.

8. The electrical connector assembly of claim 4, wherein the leaf spring is biased towards the first position.

9. The electrical connector assembly of claim 1, wherein the second threadless fastener includes a locking projection shaped, sized and positioned to secure the blade in the blade-connection port.

10. The electrical connector assembly of claim 1, wherein the second threadless fastener comprises a locking projection configured to be received by a complementary portion of the blade and thereby secure the blade to the housing, and wherein the second threadless fastener further comprises an inner surface of the housing, the locking projection and the inner surface cooperatively positioning the blade against the electrical conductor when the blade is secured to the housing.

11. The electrical connector assembly of claim 10, wherein the locking projection includes a ramped surface configured to deflect the housing, the blade, or both, when the blade passes over the locking projection.

12. The electrical connector assembly of claim 1, further comprising:

one or more additional wire-connection ports each configured to receive therein a respective electrical wire; and one or more additional threadless fasteners each configured to secure the respective wire in a corresponding one of the one or more additional wire-connection ports and electrically couple the respective wire to the electrical conductor.

13. The electrical connector assembly of claim 12, wherein the electrical conductor extends between the blade-connection port and the one or more additional wire-connection ports, the electrical conductor being configured to electrically connect each wire received in the additional wire-connection ports with the blade when received in the blade-connection port.

14. The electrical connector assembly of claim 1, wherein the wire-connection port is in opposing spaced relation to the blade-connection port.

15. The electrical connector assembly of claim 1, wherein the first threadless fastener is characterized by a lack of structure configured to mate with an external tool for operating the first threadless fastener.

16. The electrical connector assembly of claim 1, wherein the second threadless fastener is characterized by a lack of structure configured to mate with an external tool for operating the second threadless fastener.

17. The electrical connector assembly of claim 1, wherein the wire-connection port is configured to open and release the electrical wire without the use of a tool.

18. The electrical connector assembly of claim 1, wherein the first threadless fastener comprises an activation member and a spring member, the activation member being configured to move the spring member between a first position, whereat the spring member is operable to secure the wire in the wire-connection port, and a second position, whereat the spring member is displaced such that the wire can transition through the wire-connection port.

19. An electrical connector assembly for an electrical distribution system with a plurality of electrical wires and an electrically conductive blade, the electrical connector assembly comprising:

an electrically insulated housing defining a plurality of wire-connection ports and a blade-connection port, each of the wire-connection ports being configured to receive therein a respective one of the electrical wires, and the blade-connection port being configured to receive therein the electrically conductive blade;

an electrical conductor disposed within the housing and extending between the blade-connection port and the plurality of wire-connection ports;

a plurality of threadless wire-fasteners each configured to secure the respective wire in a corresponding one of the wire-connection ports and electrically couple the respective wire to the electrical conductor; and a threadless blade-fastener configured to secure the blade in the blade-connection port and electrically couple the blade to the electrical conductor;

wherein the electrical conductor is configured to electrically connect each wire received in the wire-connection ports with the blade received in the blade-connection port.

20. A light base for electrically connecting a light bulb to a power source via one or more electrical wires, the light base comprising:

an electrically insulated baseplate with a light socket;

one or more electrically conductive blades mounted on and electrically connected to the light socket;

an electrically insulated housing attached to the baseplate, the light socket, or both, and defining a wire-connection port and a blade-connection port, the wire-connection port being configured to receive therein one of the electrical wires, and the blade-connection port receiving therein one of the electrically conductive blades;

an electrical conductor disposed within the housing and extending between the blade-connection port and the wire-connection port;

a first threadless fastener configured to secure the wire received in the wire-connection port and electrically couple the wire to the electrical conductor; and a second threadless fastener securing the blade in the blade-connection port and electrically coupling the blade to the electrical conductor.

* * * * *